US012276212B2

(12) United States Patent
Roskilly et al.

(10) Patent No.: US 12,276,212 B2
(45) Date of Patent: Apr. 15, 2025

(54) HEAT ENGINE

(71) Applicant: The University of Durham, Durham (GB)

(72) Inventors: Anthony Paul Roskilly, Newcastle upon Tyne (GB); Andrew John Smallbone, Newcastle upon Tyne (GB)

(73) Assignee: The University of Durham, Durham (GB)

( * ) Notice: Subject to any disclaimer, the term of this patent is extended or adjusted under 35 U.S.C. 154(b) by 0 days.

(21) Appl. No.: 17/820,577

(22) Filed: Aug. 18, 2022

(65) Prior Publication Data

US 2022/0403758 A1 Dec. 22, 2022

Related U.S. Application Data

(63) Continuation of application No. 16/481,238, filed as application No. PCT/GB2018/050221 on Jan. 26, 2018.

(30) Foreign Application Priority Data

Jan. 27, 2017 (GB) ..... 1701368

(51) Int. Cl.

| | |
|---|---|
| ***F01K 7/36*** | (2006.01) |
| ***F01K 23/06*** | (2006.01) |
| ***F01K 25/06*** | (2006.01) |
| ***F01K 25/08*** | (2006.01) |

(52) U.S. Cl.

CPC ..... *F01K 7/36* (2013.01); *F01K 23/065* (2013.01); *F01K 25/06* (2013.01); *F01K 25/08* (2013.01)

(58) Field of Classification Search

CPC ..... Y02E 20/16; Y02E 20/18; Y02E 20/32; F01K 21/047; F01K 7/36; F01K 23/065; F01K 25/06; F01K 25/08; F02C 3/34; F02C 6/00

USPC ..... 372/60; 60/39.12, 775

See application file for complete search history.

(56) References Cited

U.S. PATENT DOCUMENTS

| | | | | |
|---|---|---|---|---|
| 3,436,914 A | | 4/1969 | Rosfelder | |
| 3,577,729 A | | 5/1971 | Warren | |
| 3,982,878 A | * | 9/1976 | Yamane | F02B 43/10 431/115 |

(Continued)

FOREIGN PATENT DOCUMENTS

| | | |
|---|---|---|
| CN | 102308063 A | 1/2012 |
| CN | 102449293 A | 5/2012 |

(Continued)

OTHER PUBLICATIONS

FR-2985767-A1, English Language Machine Translation (Year: 2013).*

(Continued)

*Primary Examiner* — Wesley G Harris

(74) *Attorney, Agent, or Firm* — Troutman Pepper Locke LLP; Ryan A. Schneider; Korbin M. Blunck

(57) ABSTRACT

A heat engine including a compressor, an expander, a reactor in which first and second reactants in a working fluid can react with each other, the reactor arranged between the compressor and the expander, and a condenser for condensing a gas in the working fluid, the condenser arranged between the expander and the compressor. There is also provided a method of operating a heat engine.

16 Claims, 3 Drawing Sheets

(56) References Cited

U.S. PATENT DOCUMENTS

| | | | | |
|---|---|---|---|---|
| 4,044,558 | A | 8/1977 | Benson | |
| 4,353,214 | A | 10/1982 | Gardner | |
| 4,398,392 | A * | 8/1983 | Ganic | F01K 25/106 60/671 |
| 5,177,952 | A * | 1/1993 | Stone | F01K 25/005 60/39.12 |
| 2002/0023423 | A1* | 2/2002 | Viteri | F02C 6/18 60/39.182 |
| 2007/0199300 | A1* | 8/2007 | MacAdam | F01K 17/025 60/39.55 |
| 2007/0234702 | A1* | 10/2007 | Hagen | F01K 23/12 60/39.01 |
| 2011/0067383 | A1 | 3/2011 | Kuroki et al. | |
| 2012/0024264 | A1 | 2/2012 | Mikalsen et al. | |
| 2013/0125842 | A1* | 5/2013 | Frick | F22B 1/1807 122/7 R |
| 2014/0150430 | A1* | 6/2014 | Helbig | F01K 7/165 60/656 |
| 2014/0250911 | A1* | 9/2014 | Huntington | F25J 1/025 60/39.5 |

FOREIGN PATENT DOCUMENTS

| | | | |
|---|---|---|---|
| CN | 103026031 | A | 4/2013 |
| CN | 103748323 | A | 4/2014 |
| CN | 105324571 | A | 2/2016 |
| EP | 2587006 | A1 * | 5/2013 |
| EP | 2738360 | A1 * | 6/2014 |
| FR | 2981982 | A1 * | 5/2013 |
| FR | 2985767 | A1 * | 7/2013 |
| GB | 2058935 | A | 4/1981 |
| GB | 2469279 | A | 10/2010 |
| JP | H03 258902 | A | 11/1991 |
| JP | H09144561 | A | 6/1997 |
| JP | 2880938 | B2 | 4/1999 |
| JP | 2010096111 | A | 4/2010 |
| WO | 2009031005 | A2 | 3/2009 |
| WO | 2010116172 | A1 | 10/2010 |
| WO | WO-2014137648 | A1 * | 9/2014 |
| WO | 2016019357 | A1 | 2/2016 |

OTHER PUBLICATIONS

EP Search Report issued in application No. GB1701368.1 mailed Jun. 9, 2017.

The International Preliminary Report on Patentability issued in International Patent Application No. PCT/GB2018/050221 mailed Aug. 8, 2019.

Bell and Partridge, "Thermodynamic Design of a Reciprocating Joule Cycle Engine," 2003 Proc. Instn Mech. Engrs vol. 217 Part !: J. Power and Energy pp. 240-246.

Moss, et al., "Reciprocating Joule_Cycle Engine for Domestic CH Systems," 2005 Applied Energy 80 pp. 169-185.

International Search Report and Written Opnion from Application No. PCT/GB2018/050221 dated May 17, 2018.

Office Action and Search Report from CN Application No. 201880020427.4 dated Jun. 16, 2021 (with English translation).

International Search Report and Written Opinion from Application No. PCT/GB2018/050221 dated May 17, 2018.

Office Action from Chinese Application No. 202211072135 dated Jan. 11, 2025.

* cited by examiner

HEAT ENGINE

CROSS-REFERENCE TO RELATED APPLICATIONS

This application is a continuation of U.S. patent application Ser. No. 16/481,238 filed 26 Jul. 2019, which is a § 371 national stage of International Application PCT/GB2018/050221, with an international filing date of 26 Jan. 2018, which claims the benefit of GB Patent Application Serial No. 1701368.1, filed on 27 Jan. 2017, the benefit of the earlier filing date of which is hereby claimed under 35 USC § 119(a)-(d) and (f). The entire contents and substance of all applications are hereby incorporated by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

SEQUENCE LISTING

Not Applicable

STATEMENT REGARDING PRIOR DISCLOSURES BY THE INVENTOR OR A JOINT INVENTOR

Not Applicable

BACKGROUND OF THE DISCLOSURE

1. Field of the Disclosure

The various embodiments of the present disclosure relate generally to heat engines.

2. Background

Efficient conversion of heat into mechanical work has concerned researchers and engineers for more than a century, and recent years have seen an increasing focus on energy efficiency and pollutant emissions from power generation driven by government regulation and consumer demands. There is therefore a continuous drive to improve heat engine technology for a wide variety of applications.

Examples of such efforts include Bell M A, Partridge T. Thermodynamic design of a reciprocating Joule-cycle engine. Proc. Inst. Mech. Eng.: Journal of Power and Energy, vol. 217, pages 239-246, 2003, Moss R W et al., Reciprocating Joule cycle engine for domestic CHP systems, Applied Energy vol. 80, pages 169-185, 2005, U.S. Pat. Nos. 3,577,729 and 4,044,558 and international patent application WO 2010/116172.

BRIEF SUMMARY OF THE DISCLOSURE

The present invention relates to an engine concept for the conversion of energy from solid, liquid, or gaseous fuels into, for example, electric, hydraulic, or pneumatic energy. It is intended for use in applications such as electric power generation, combined heat and power systems, propulsion systems, and other applications in which conventional combustion engines or other types of energy converters are presently used.

According to a first aspect of the present invention, there is provided a heat engine comprising a compressor, an expander, a first conduit fluidly coupling an outlet of the compressor to an inlet of the expander, a second conduit fluidly coupling an outlet of the expander to an inlet of the compressor, a reactor in which first and second reactants in a working fluid can react with each other, the reactor arranged in the first conduit between the compressor and the expander, and a condenser for condensing a gas in the working fluid, the condenser arranged in the second conduit between the expander and the compressor.

In an embodiment, the compressor comprises a compression chamber and a first positive displacement member reciprocable within the compression chamber, and the expander comprises an expansion chamber and a second positive displacement member reciprocable within the expansion chamber.

In an embodiment, the first and second positive displacement members are mechanically coupled to reciprocate in unison in a free-piston configuration.

In an embodiment, the first and second positive displacement members are connected via a crankshaft.

According to a second aspect of the present invention, there is provided a heat engine comprising:

a compression chamber, a first positive displacement element reciprocable within the compression chamber, an expansion chamber, a second positive displacement element reciprocable within the expansion chamber, wherein the first and second positive displacement elements are mechanically coupled to reciprocate in unison in a free-piston configuration, a first conduit fluidly coupling an outlet of the compression chamber to an inlet of the expansion chamber, a second conduit fluidly coupling an outlet of the expansion chamber to an inlet of the compression chamber, a reactor in which first and second reactants in a working fluid can react with each other, the reactor arranged in the first conduit (between the compression chamber and the expansion chamber), and a condenser for condensing a gas in working fluid in the second conduit, the condenser arranged in the second conduit between the expansion chamber and the compression chamber.

The heat engine may further comprise a first supply line configured for supplying the first reactant into the first and/or second conduit.

The reactor may comprise a second supply line for supplying the second reactant into the working fluid.

The condenser may comprise a drainage line for draining the condensate from the condenser. The condenser may comprise a cooling circuit for cooling working fluid from the expansion chamber.

The heat engine may further comprise a working fluid. The working fluid may comprise a diluent, the concentration of the diluent in the working fluid being at least 5% by volume, or at least 10% by volume, or at least 20% by volume, or at least 30% by volume, or at least 40% by volume, or at least 50% by volume, or at least 60% by volume, or at least 70% by volume, or at least 80% by volume.

The diluent may have a ratio of specific heats which at least 1.4, or at least 1.45, or at least 1.5, or at least 1.6. The diluent may be Ar, He, Ne, Kr, or Xe.

The concentration of $N_2$ in the working fluid may be less than 70% by volume, less than 60% by volume, less than 50% by volume, less than 40% by volume, less than 30% by volume, less than 20% by volume, less than 10% by volume, or less than 5% by volume.

The heat engine may further comprise a first valve for controlling the flow of working fluid into the compression chamber, a second valve for controlling the flow of working fluid out of the compression chamber, a third valve for controlling the flow of working fluid from the compression chamber into the expansion chamber, and a fourth valve for controlling the flow of working fluid out of the expansion chamber.

The heat engine may further comprise a sensor adapted to output a signal corresponding to a position and/or velocity of the first and second positive displacement elements, and a controller for continuously controlling the third and/or fourth valves and/or the rate of supply of the second reactant to the reactor in accordance with the signal output by the sensor. The controller may be configured to control the first, second, third and fourth valves.

The second displacement member may divide the expansion chamber into two expansion subchambers. The third valve may be adapted to control the flow of working fluid alternately to each expansion subchamber.

The first displacement member may divide the compression chamber into two compression subchambers. The first valve may be adapted to control the flow of working fluid alternately to each compression subchamber.

The heat engine may further comprise an energy conversion device comprising at least one reciprocable element coupled for reciprocation with the first and second displacement members. The energy conversion device may be positioned between the compression chamber and the expansion chamber.

The compressor may be a turbomachine and the expander may be a turbomachine.

The compressor and the expansion cylinder may be connected via a shaft.

According to a third aspect of the present invention, there is provided a heat engine comprising:

a reactor, a condenser for condensing a gas in a working fluid of the heat engine, a first conduit fluidly coupling an outlet of the reactor to an inlet of the condenser, and a second conduit fluidly coupling an outlet of the condenser to an inlet of the reactor.

The reactor may be a combustion chamber of an internal combustion engine.

The heat engine may further comprise a first supply line configured for supplying a first reactant into the first and/or second conduit.

The heat engine may comprise a second supply line for supplying a second reactant into the working fluid.

The second supply line may be configured to supply the second reactant:

into the second conduit, or into the reactor.

The condenser may comprise a drainage line for draining the condensate from the condenser.

The condenser may comprise a cooling circuit for cooling the working fluid.

The heat engine may further comprise a working fluid, wherein the working fluid comprises a diluent, the concentration of the diluent in the working fluid being at least 5% by volume, or at least 10% by volume, or at least 20% by volume, or at least 30% by volume, or at least 40% by volume, or at least 50% by volume, or at least 60% by volume, or at least 70% by volume, or at least 80% by volume.

The diluent may have a ratio of specific heats which is at least 1.4, or at least 1.45, or at least 1.5, or at least 1.6.

The diluent may be Ar, He, Ne, Kr, or Xe.

The concentration of $N_2$ in the working fluid may be less than 70% by volume, less than 60% by volume, less than 50% by volume, less than 40% by volume, less than 30% by volume, less than 20% by volume, less than 10% by volume, or less than 5% by volume.

According to a fourth aspect of the present invention, there is provided a method of operating the heat engine according to the first, second or third aspects, the method comprising:

providing a working fluid to the heat engine, wherein the working fluid comprises a diluent, and the concentration of the diluent in the working fluid is at least 5% by volume.

The concentration of diluent in the working fluid may be at least 10% by volume, or at least 20% by volume, or at least 30% by volume, or at least 40% by volume, or at least 50% by volume, or at least 60% by volume, or at least 70% by volume, or at least 80% by volume.

The diluent may have a ratio of specific heats which is at least 1.4, or at least 1.45, or at least 1.5, or at least 1.6.

The diluent may include any of Ar, He, Ne, Kr, or Xe.

The concentration of $N_2$ in the working fluid may be less than 70% by volume, or less than 60% by volume, or less than 50% by volume, or less than 40% by volume, or less than 30% by volume, or less than 20% by volume, or less than 10% by volume, or less than 5% by volume.

The first and a second reactant may be supplied into the working fluid.

The first reactant may be $O_2$.

The second reactant may be $H_2$.

The combustion product may be condensed in the condenser, the combustion product comprising $H_2O$.

These and other aspects of the present disclosure are described in the Detailed Description below and the accompanying drawings. Other aspects and features of embodiments will become apparent to those of ordinary skill in the art upon reviewing the following description of specific, exemplary embodiments in concert with the drawings. While features of the present disclosure may be discussed relative to certain embodiments and figures, all embodiments of the present disclosure can include one or more of the features discussed herein.

Further, while one or more embodiments may be discussed as having certain advantageous features, one or more of such features may also be used with the various embodiments discussed herein. In similar fashion, while exemplary embodiments may be discussed below as device, system, or method embodiments, it is to be understood that such exemplary embodiments can be implemented in various devices, systems, and methods of the present disclosure.

BRIEF DESCRIPTION OF THE DRAWINGS

The following detailed description of specific embodiments of the disclosure will be better understood when read in conjunction with the appended drawings. For the purpose of illustrating the disclosure, specific embodiments are shown in the drawings. It should be understood, however, that the disclosure is not limited to the precise arrangements and instrumentalities of the embodiments shown in the drawings.

DETAILED DESCRIPTION

Figure 1:
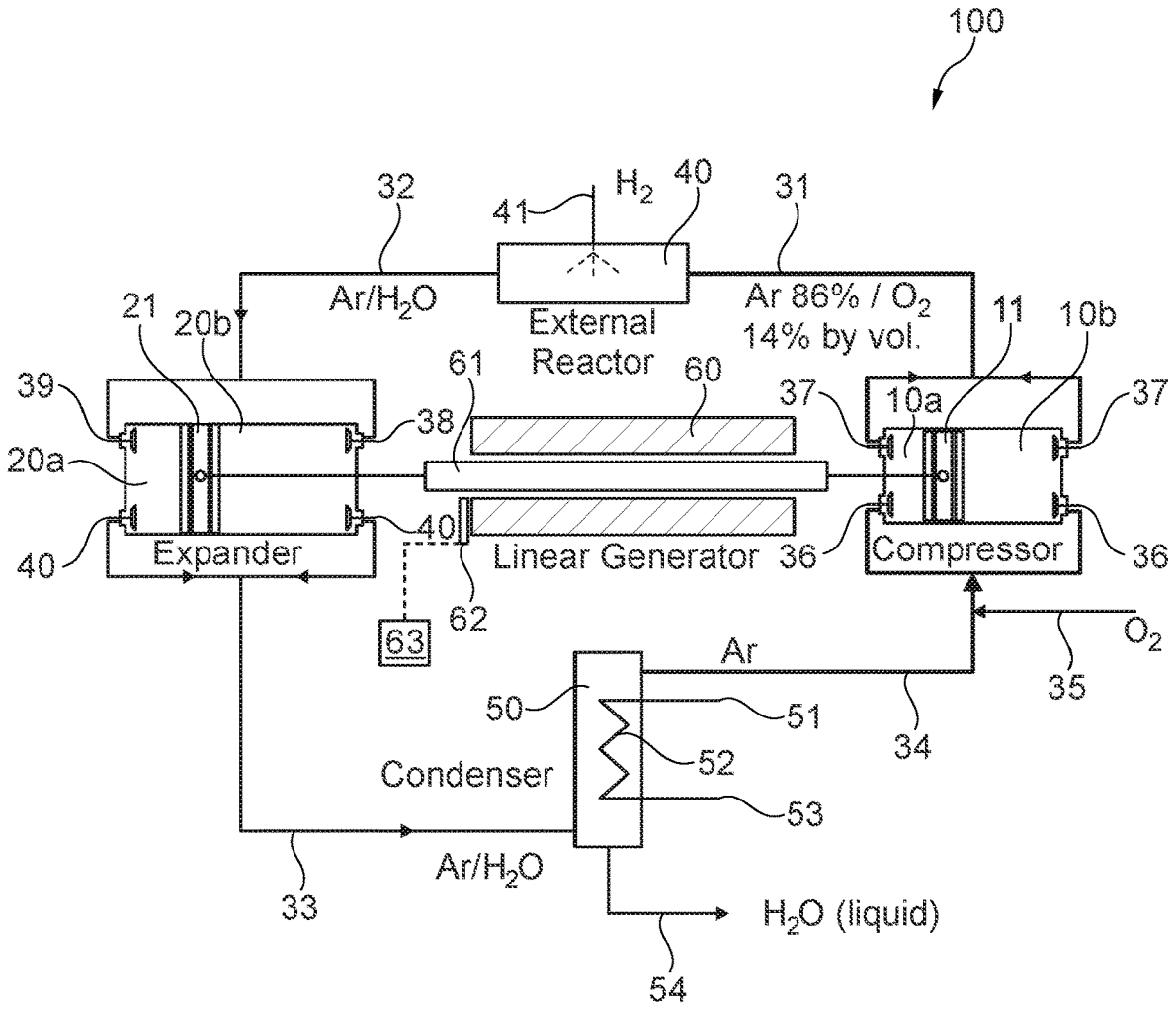
FIG. 1 illustrates an example of a heat engine.

Although preferred exemplary embodiments of the disclosure are explained in detail, it is to be understood that other exemplary embodiments are contemplated. Accordingly, it is not intended that the disclosure is limited in its scope to the details of construction and arrangement of components set forth in the following description or illustrated in the drawings. The disclosure is capable of other exemplary embodiments and of being practiced or carried out in various ways. Also, in describing the preferred exemplary embodiments, specific terminology will be resorted to for the sake of clarity.

As used in the specification and the appended claims, the singular forms "a," "an" and "the" include plural referents unless the context clearly dictates otherwise.

Also, in describing the preferred exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges can be expressed herein as from "about" or "approximately" one particular value and/or to "about" or "approximately" another particular value. When such a range is expressed, another exemplary embodiment includes from the one particular value and/or to the other particular value.

Using "comprising" or "including" or like terms means that at least the named compound, element, particle, or method step is present in the composition or article or method, but does not exclude the presence of other compounds, materials, particles, method steps, even if the other such compounds, material, particles, method steps have the same function as what is named.

Mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

Thus, to facilitate an understanding of the principles and features of the present disclosure, various illustrative embodiments are explained below. The components, steps, and materials described hereinafter as making up various elements of the embodiments disclosed herein are intended to be illustrative and not restrictive. Many suitable components, steps, and materials that would perform the same or similar functions as the components, steps, and materials described herein are intended to be embraced within the scope of the disclosure. Such other components, steps, and materials not described herein can include, but are not limited to, similar components or steps that are developed after development of the embodiments disclosed herein.

FIG. 1 illustrates a heat engine 100 according to one example. The heat engine 100 has a compressor. In this example the compressor is a compression cylinder with a compression chamber having two compression subchambers 10*a* and 10*b*. A first positive displacement element 11 is arranged to be reciprocable within the compression chamber. In this example, the first positive displacement member 11 is a double-acting piston which divides the compression chamber into the two separate compression subchambers 10*a* and 10*b*.

The engine further has an expander. In this example the expander is an expansion cylinder with an expansion chamber having two expansion subchambers 20*a* and 20*b*. A second positive displacement element 21 is reciprocable within the expansion chamber. In this example, the second positive displacement element 21 is a double-acting piston which divides the expansion chamber into the two expansion subchambers 20*a* and 20*b*.

The first and second positive displacement elements 11 and 21 are mechanically coupled via a piston rod. As such, the first and second positive displacement elements 11 and 21 are configured to reciprocate in unison in a free-piston configuration. That is, reciprocal motion of the first positive displacement element within the compression chamber corresponds to reciprocal motion of the second positive displacement element within the expansion chamber.

In use, the engine will operate with a working fluid. A first conduit 31, 32 is arranged for conducting the working fluid from the compression chambers 10*a*, 10*b* to the expansion chambers 21*a*, 21*b*. The first conduit 31, 32 fluidly couples an outlet of the compression chambers 10*a*, 10*b* to an inlet of the expansion chambers 21*a*, 21*b*. Thus, in use, working fluid may flow from the compression chamber to the expansion chamber.

A second conduit 33, 34 is arranged for conducting the working fluid from the expansion chambers 20*a*, 20*b* to the compression chambers 10*a*, 10*b*. The second conduit 33, 34 fluidly couples an outlet of the expansion chambers 20*a*, 20*b* to an inlet of the compression chambers 10*a*, 10*b*. Thus, in use, working fluid may flow from the expansion chamber to the compression chamber.

A first supply line 35 is configured for controlling the flow of a first reactant into the first and/or second conduit 31-34. In the example shown in FIG. 1, the first reactant is $O_2$, and the first supply line 35 is positioned in the second conduit 34, upstream the compressor cylinder. That is, the first supply line 35 fluidly couples to the second conduit 34 so that the first reactant may flow from e.g., an external supply reservoir into the second conduit 34. The supply line 35 may, however, be positioned at other points in the cycle, such as downstream the compressor cylinder e.g., in the first conduit 31.

The engine further has a reactor 40 in which first and second reactants in the working fluid can react with each other. The reactor 40 may include a second supply line 41 for supplying the second reactant. The reactor 40 is arranged in the first conduit 31, 32, i.e. between the compressor cylinder and the expansion cylinder. The reactor 40 is configured to supply a second reactant via the second supply line 41 into the working fluid in the conduit and cause the second reactant to react with the first reactant. The reactor may be a combustor, similar to those known from conventional open-cycle engines, such as gas turbines. In this example, the reactor 41 may include a reaction chamber and an igniter and the reaction between the first and second reactants may be caused by ignition of the reactants in the working fluid within the reaction chamber. Alternatively, the reactor 40 may be designed equivalently to a gas fueled furnace, or have a different design, for example if using unconventional pairs of reactants. In the example shown, the second reactant is $H_2$.

Further, a condenser 50 is arranged in the second conduit 33, 34. The condenser 50 receives the working fluid from the expansion cylinder and cools it to condense a gas in the working fluid. The condenser 50 is configured to remove condensate from the working fluid and drain it from the heat engine. In this example, the condenser 50 has a drainage line 54 for removing a condensate from the working fluid by draining the condensate from the condenser 50. The remaining working fluid flows from the condenser through the second conduit 34 to the compression cylinder. In this example, in which the first reactant is $O_2$ and the second reactant is $H_2$, $H_2$ will react with $O_2$ in the reactor 41, so the condensate will be water $H_2O$. The condenser, in this example, includes a cooling circuit 51, 53 with a heat exchanger 52 for cooling the working fluid, in the conventional manner.

Valves are arranged with the compression and expansion cylinders in order to control engine operation. A first set of valves 36 controls the flow of working fluid into the inlet of the compression chambers 10*a*, 10*b* from the conduit 34. A second set of valves 37 controls the flow of working fluid out of the outlet of the compression chambers 10*a*, 10*b* and into the conduit 31. A third set of valves 39 controls the flow of working fluid into the inlet of the expansion chambers 20*a*, 20*b* from the conduit 32. A fourth set of valves 40 controls the flow of working fluid out of the outlet of the expansion chambers 20*a*, 20*b* and into the conduit 33.

A sensor 62 is adapted to measure a signal corresponding to a position and/or velocity of the first/second positive displacement element 11, 21. In the example shown in FIG. 1, the sensor 62 operates on the piston rod connecting the two double-acting pistons. That is, the sensor 62 measures the position and/or velocity of the piston rod connecting the first and second positive displacement elements 11, 21. The sensor 62 may, however, be arranged, for example, in relation to one of the double-acting pistons to measure the piston's position. The sensor may output the signal to a controller 63.

The controller 63 receives the sensor signal and continuously controls the third and/or fourth set of valves 39, 40 and/or the rate of supply of reactant to the reactor 40 in accordance with the signal output by the sensor 62. The controller 63 may control all of the first, second, third and fourth set of valves 36-40. Alternatively, the valves 36 and 37 associated with the compression cylinder may be self-controlled, one-way valves. In the example shown in FIG. 1, the third set of valves 39 is adapted to control the flow of working fluid alternately to each expansion subchamber 20*a*, 20*b*. Similarly, the first set of valves 36 is adapted to control the flow of working fluid alternately to each compression subchamber 10*a*, 10*b*.

An energy conversion device 60, 61 is provided in association with the piston rod. The energy conversion device in this example is a linear electric machine including a translator 61 coupled for reciprocation with the first and second displacement members 11, 21 and a stator 60 fixed to e.g., the engine housing. The linear electric machine may be of any type, for example a permanent magnet machine having permanent magnets arranged on the translator 61 and coils arranged on the stator 60. In this example, the energy conversion device 60, 61 is positioned between the compression cylinder and the expansion cylinder, but other configurations may also be possible if beneficial for the overall layout of the heat engine 100. In other examples, the energy conversion device 60, 61 may be, for example, a hydraulic piston-cylinder arrangement or an air compressor.

By means of the condenser 50, the engine can work on a semi-closed cycle. The working fluid of the engine includes a diluent. In the example shown the diluent is argon.

The concentration of diluent in the working fluid may be greater than 5% by volume, or greater than 10% by volume, greater than 20% by volume, or greater than 30% by volume, greater than 40% by volume, or greater than 50% by volume, greater than 60% by volume, or greater than 70% by volume, or greater than 80% by volume. A higher concentration of diluent in the working fluid can generally give improved performance and greater advantages, as discussed below. Aptly, the concentration of diluent is greater than 60% by volume.

The diluent has a ratio of specific heats which is greater than 1.4, or greater than 1.45, or greater than 1.5 or greater than 1.6. Aptly, the diluent has a ratio of specific heats which is greater than 1.4.

In other examples, the diluent may be helium (He), neon (Ne), argon (Ar), krypton (Kr), or xenon (Xe). Alternatively, other monatomic gases, or a mixture of gases, with very low chemical reactivity and/or with a high ratio of specific heats, for example greater than that of nitrogen, may advantageously be used as diluent.

Alternatively, or additionally, the concentration of $N_2$ in the working fluid is less than 70% by volume, less than 60% by volume, less than 50% by volume, less than 40% by volume, less than 30% by volume, less than 20% by volume, less than 10% by volume, or less than 5% by volume. Aptly, the concentration of $N_2$ is less than 5% by volume.

In operation, the piston assembly, including the positive displacement elements 11, 21, the translator 61, and the associated piston rod, reciprocates between left-hand-side and right-hand-side endpoints. During this process, working fluid will be compressed in the compressor cylinder.

The pressure ratio across the compressor cylinder (i.e. the pressure ratio between pressure of the working fluid as it enters the compression chamber at the compression chamber inlet, and pressure of the working fluid as it leaves the compression chamber at the compression chamber outlet) may, for example, be between 5 and 10. That is, the compression cylinder may increase the pressure of the working fluid to between 5 and 10 times the pressure of the working fluid before entering the compression cylinder. However, other pressure ratios are possible, depending on the specific application.

In this example, the working fluid at the point in the cycle where compression occurs includes approximately 86% argon and 14% $O_2$. Other ratios of argon to $O_2$ may be possible, and other gases may, alternatively, also be present. In other examples, a different diluent to argon may be used as described above. Similarly, $O_2$ may be replaced with another suitable reactant.

Compressed working fluid, including the first reactant $O_2$, is conducted along the first conduit 31 and supplied to the reactor 40. At the reactor 40, the second reactant $H_2$ is added to the working fluid. The second reactant reacts with the first reactant (e.g., due to ignition by the reactor) to produce high-temperature combustion products.

In this example, the working fluid downstream the reactor 40 will include a mixture of argon and $H_2O$, the latter being the products of the reaction between $H_2$ and $O_2$. The amount of $H_2$ and $O_2$ supplied into the cycle can be controlled in order to control cycle temperatures. For example, a temperature out of the reactor 40 of approximately 800 degrees Celsius may be used, however other temperatures may be used, depending on the specific system design and materials properties. Generally, a temperature as high as permitted by materials properties is beneficial for the overall efficiency of the heat engine 100.

The working fluid from the reactor 40 flows through the first conduit 32 to the expansion chamber 20*a*, 20*b*. This high-temperature mixture is expanded in the expansion cylinder. The expanded working fluid is then supplied from the expansion cylinder to the condenser by flowing from the expansion chamber 20*a*, 20*b* and through the second conduit 33.

In the condenser 50, the fluid is cooled such that the water condenses and can be removed from the working fluid. The water drains from the condenser 50 through the drainage line 54. The remaining working fluid, in this example substantially pure argon, is supplied to the conduit 34, into which new $O_2$ is supplied. The working fluid is led to the compression cylinder, compressed, and supplied to the reactor 40 as described above.

The work produced by expanding the working fluid in the expansion cylinder is used directly to compress the working fluid in the compressor cylinder, and excess work is extracted by the energy conversion device 60, 61 for use externally or for storage.

Figure 2:
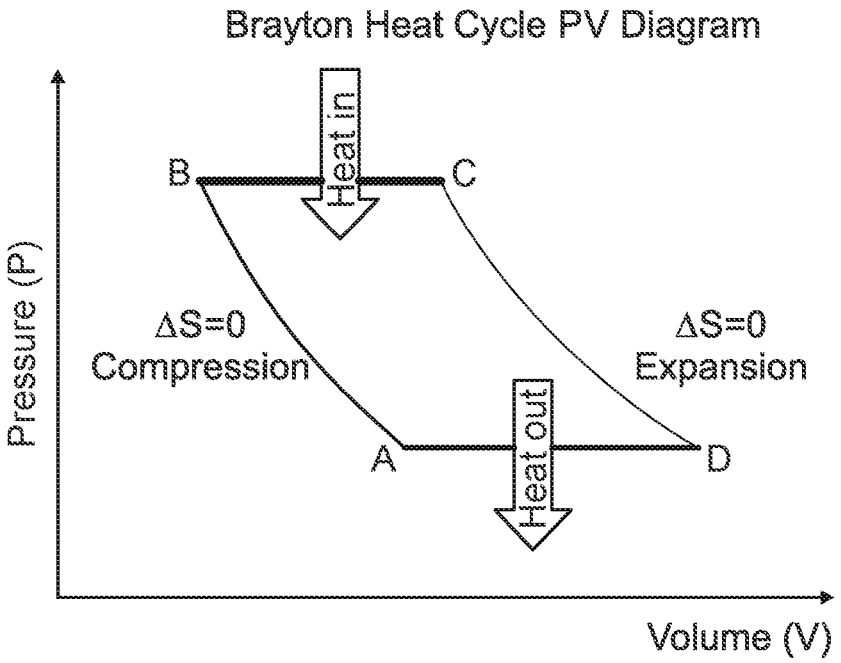
FIG. 2 illustrates the Brayton cycle PV diagram.

The cycle thus operates substantially on a Brayton (Joule) cycle. The theoretical Brayton cycle is illustrated in FIG. 2: A-B is the adiabatic reversible compression, when working fluid is drawn into and compressed in the compressor. B-C is the constant pressure combustion—idealized as constant pressure heat addition, when reactant is combusted at constant pressure. C-D is the adiabatic reversible expansion, when hot, high pressure working fluid enters the expander chambers and expand in the subchambers alternatively, to push the piston conducting linear motion back and forth. The mechanical power from the linear motion is partly to drive the compressor piston for the compression process, and the remaining power is the output to drive the linear generator for electricity generation. D-A is the constant pressure exhaust process, which is the constant pressure ejection of the expanded hot working fluid.

Figure 3:
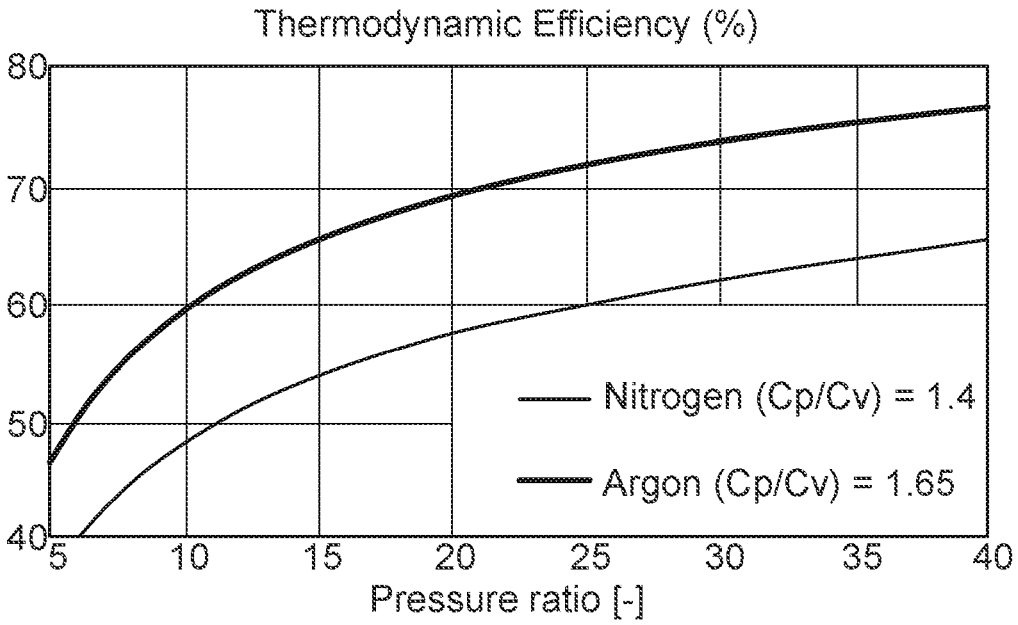
FIG. 3 illustrates the theoretical thermal efficiency of the Brayton cycle.

By using a diluent which has a higher ratio of specific heats than atmospheric air or $N_2$, a higher efficiency can be obtained. For example, the utilization of argon as the main working fluid increases the overall efficiency of the cycle relative to nitrogen (as if it were an open system) for the Brayton Cycle over a range of pressure ratio as shown in FIG. 3. This is because of the relative differences between the ratio of specific heats for nitrogen ($\gamma$=1.4) and argon ($\gamma$=1.6). Unlike nitrogen, combustion in the presence of argon further does not result in nitrous oxides ($NO_x$). The engine may therefore be operated with a reduced $N_2$ content in the working fluid.

In an alternative embodiment, the compressor and expander may be provided by a different type of reciprocating piston machine. The piston machine may, for example, be a conventional crankshaft machine, in which the compressor piston and the expander piston are connected by means of a crankshaft. That is, the first and second positive displacement members 11, 21 are connected via a crankshaft. In this embodiment, the energy conversion device may, for example, be a rotating electric generator, a rotating hydraulic generator, a rotating pneumatic generator, a different type of rotating energy converter, or the heat engine may be directly coupled to a load. In this alternative embodiment, the interaction between the compression cylinder, the expansion cylinder, the first and second conduits, the condenser and the reactor is otherwise as described with regards to the previously described embodiment.

In yet another alternative embodiment, the compressor and expander may be provided by turbomachines. For example, such technology known from gas turbines may be utilized in this embodiment. In this embodiment, the compressor and the expander are connected via a shaft. In this embodiment, the energy conversion device may, for example, be a rotating electric generator, a rotating hydraulic generator, a rotating pneumatic generator, a different type of rotating energy converter, or the heat engine may be directly coupled to a load. In this alternative embodiment, the interaction between the compressor, the expander, the first and second conduits, the condenser and the reactor is otherwise as described with regards to the previously described embodiment.

An engine according to the above-described examples thus offers an effective solution as very good control of combustion is obtained as it takes place continuously at constant volume. In the examples above, the free piston configuration has the advantage of improved control of the system operation, in that the variable stroke length of the free-piston arrangement permits control of the compressor and expander cylinder displacement, and thus improves the ability of the system to handle load variations and/or to be optimized for any given operational settings. The pressure ratio of the system may, for example, be varied by adjusting the stroke length of the piston assembly. The system is therefore, for example, well-suited to handle applications with varying load requirements, or operation on different reactant pairs or with different diluents or diluent mixtures. Moreover, in the example shown in FIG. 1, the double-acting piston-cylinder arrangements provide advantages in that any leakage of working fluid past the pistons will not lead to a loss of working fluid. This relaxes sealing requirements, thus permitting, for example, the use of a low-friction piston-cylinder design.

Figure 4:
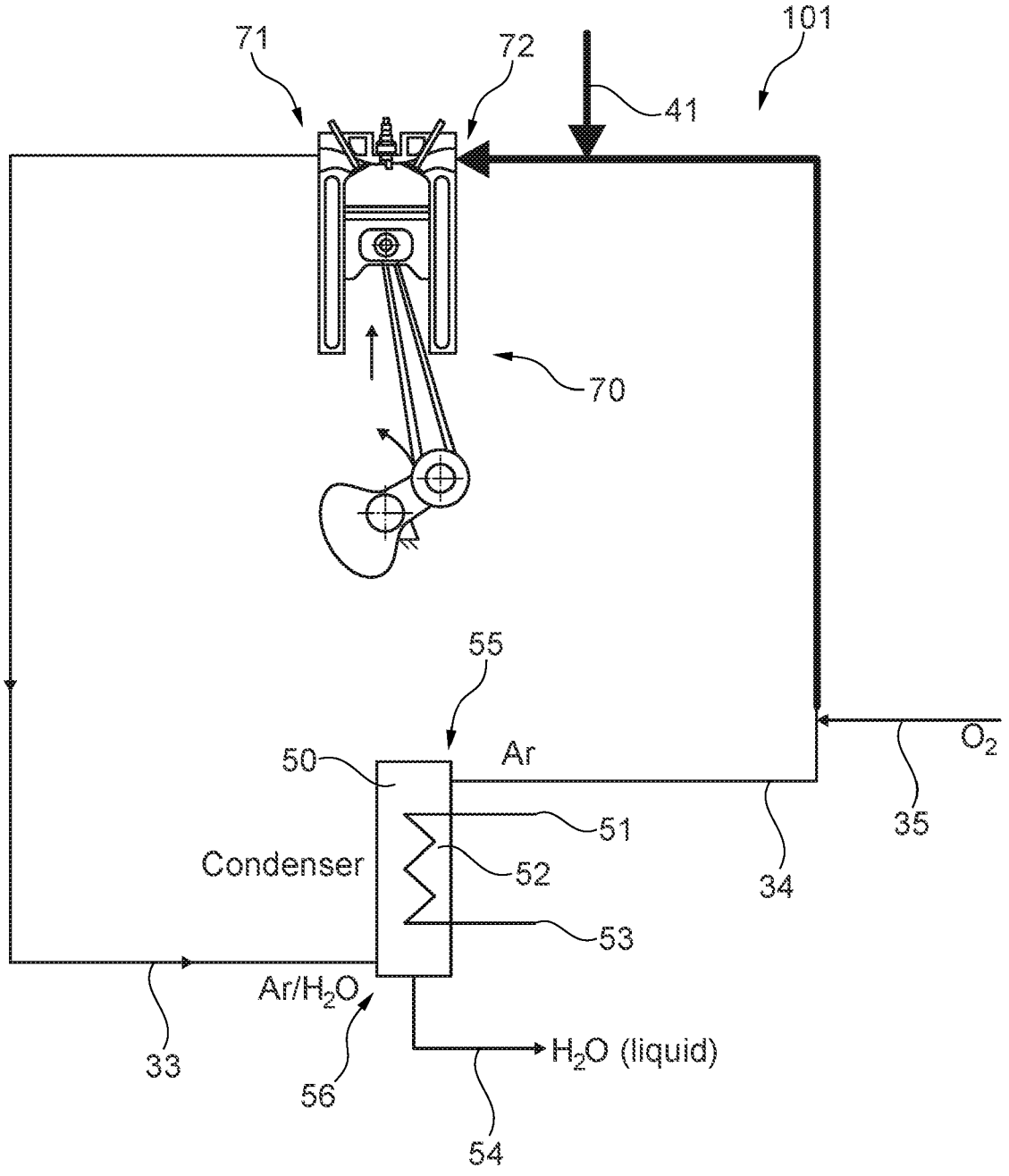
FIG. 4 illustrates a heat engine according to an embodiment.

In another embodiment, illustrated schematically in FIG. 4, the heat engine 101 comprises a reactor, a condenser 50 for condensing a gas in a working fluid of the heat engine 101, a first conduit 33 fluidly coupling an outlet 71 of the reactor to an inlet 56 of the condenser 50; and a second conduit 34 fluidly coupling an outlet 55 of the condenser 50 to an inlet 72 of the reactor.

In this example the reactor is the combustion chamber of an internal combustion (IC) engine 70.

The IC engine may be a free-piston engine, a conventional, crankshaft engine, as illustrated in FIG. 4, or a different type of IC engine.

A first supply line 35 is configured for supplying a first reactant into the second conduit 34, or, alternatively, into the first conduit 33, or, alternatively into both the first and second conduits 33, 34. In this embodiment, the first reactant is $O_2$.

A second supply line 41 is provided for supplying a second reactant into the working fluid. The second reactant is, in this embodiment, $H_2$. The second reactant can be supplied into the first or second conduit 33, 34 (which may include the intake system of the engine), or directly into the reactor (e.g., the combustion chamber of the internal combustion engine 70). The IC engine may be a spark ignition engine or a compression ignition engine. The engine may be an HCCI engine.

The working fluid is thus operated in a substantially closed loop. A diluent may be used, similarly as described above. Reactants can be injected into the working fluid and combustion products can be condensed and removed from the condenser 50, similarly as described above. In this example the combustion product is condensed in the condenser, the combustion product comprising $H_2O$.

In this embodiment, power can thus be generated by the IC engine at high efficiency and with low emissions, in a mechanically simple and reliable system.

In the same manner as the previously described embodiments, the condenser 50 comprises a drainage line 54 for draining the condensate from the condenser 50. Similarly, the condenser 50 comprises a cooling circuit 53, 57 for cooling the working fluid.

In this embodiment, the heat engine includes a working fluid. The first and second reactants are supplied into the working fluid as discussed above. The working fluid comprises a diluent, the concentration of the diluent in the working fluid being at least 5% by volume. Aptly, the concentration of the diluent in the working fluid may be at least 10% by volume, or at least 20% by volume, or at least 30% by volume, or at least 40% by volume, or at least 50% by volume, or at least 60% by volume, or at least 70% by volume, or at least 80% by volume.

In addition, the diluent has a ratio of specific heats which is at least 1.4. Aptly the diluent may have a ration of specific heats of at least 1.45, or at least 1.5, or at least 1.6.

In this embodiment, the diluent is one of Ar, He, Ne, Kr, or Xe.

In this embodiment, the concentration of $N_2$ in the working fluid is less than 70% by volume. Aptly, the concentration of $N_2$ in the working fluid may be less than 60% by volume, less than 50% by volume, less than 40% by volume, less than 30% by volume, less than 20% by volume, less than 10% by volume, or less than 5% by volume.

Embodiments according to the present invention may be suitable for applications such as hybrid-electric vehicles, stationary power generation, micro combined heat and power, portable/auxiliary power generators, and emergency/uninterrupted power systems.

The present invention is not limited to the embodiments described herein. Reference should be had to the appended claims.

Further examples are disclosed in the below numbered clauses, which are not to be confused with the claims.

1. A heat engine (100) comprising:
   - a compressor (10*a*, 10*b*, 11);
   - an expander (20*a*, 20*b*, 21);
   - a first conduit (31, 32) fluidly coupling an outlet of the compressor (10*a*, 10*b*, 11) to an inlet of the expander (20*a*, 20*b*, 21);
   - a second conduit (33, 34) fluidly coupling an outlet of the expander (20*a*, 20*b*, 21) to an inlet of the compressor (10*a*, 10*b*, 11);
   - a reactor (40) in which first and second reactants in a working fluid can react with each other, the reactor (40) arranged in the first conduit (31, 32) between the compressor (10*a*, 10*b*, 11) and the expander (20*a*, 20*b*, 21); and
   - a condenser (50) for condensing a gas in the working fluid, the condenser arranged in the second conduit (33, 34) between the expander (20*a*, 20*b*, 21) and the compressor (10*a*, 10*b*, 11).

2. A heat engine (100) according to clause 1, wherein the compressor (10*a*, 10*b*, 11) comprises a compression chamber (10*a*, 10*b*) and a first positive displacement member (11) reciprocable within the compression chamber (10*a*, 10*b*), and the expander (20*a*, 20*b*, 21) comprises an expansion chamber (20*a*, 20*b*) and a second positive displacement member (21) reciprocable within the expansion chamber (20*a*, 20*b*).

3. A heat engine (100) according to clause 2, wherein:
   - the first and second positive displacement members (11, 21) are mechanically coupled to reciprocate in unison in a free-piston configuration, or
   - the first and second positive displacement members (11, 21) are connected via a crankshaft.

4. A heat engine (100) according to clause 1, wherein the compressor (10*a*, 10*b*, 11) is a turbomachine and the expander (20*a*, 20*b*, 21) is a turbomachine.

5. A heat engine (100) according to clause 4, wherein the compressor (10*a*, 10*b*, 11) and the expander (20*a*, 20*b*, 21) are connected via a shaft.

6. A heat engine according to any preceding clause, further comprising a first supply line (35) configured for supplying the first reactant into the first and/or second conduit (31, 32, 33, 34).

7. A heat engine according to any preceding clause, wherein the reactor (40) comprises a second supply line (41) for supplying the second reactant into the working fluid.

8. A heat engine according to any preceding clause, wherein the condenser (50) comprises a drainage line (54) for draining the condensate from the condenser (50).

9. A heat engine according to any preceding clause, wherein the condenser (50) comprises a cooling circuit (53, 57) for cooling working fluid.

10. A heat engine according to any preceding clause, further comprising a working fluid, wherein the working fluid comprises a diluent, the concentration of the diluent in the working fluid being at least 5% by volume, or at least 10% by volume, or at least 20% by volume, or at least 30% by volume, or at least 40% by volume, or at least 50% by volume, or at least 60% by volume, or at least 70% by volume, or at least 80% by volume.

11. A heat engine according to clause 10, wherein the diluent has a ratio of specific heats which is at least 1.4, or at least 1.45, or at least 1.5, or at least 1.6.

12. A heat engine according to clause 10 or 11, wherein the diluent is Ar, He, Ne, Kr, or Xe.

13. A heat engine according to any preceding clause, wherein the concentration of $N_2$ in the working fluid is less than 70% by volume, less than 60% by volume, less than 50% by volume, less than 40% by volume, less than 30% by volume, less than 20% by volume, less than 10% by volume, or less than 5% by volume.

14. A heat engine according to any preceding clause, further comprising:
   - a first valve (36) for controlling the flow of working fluid into the compression chamber (10*a*, 10*b*);
   - a second valve (37) for controlling the flow of working fluid out of the compression chamber (10*a*, 10*b*);
   - a third valve (39) for controlling the flow of working fluid from the compression chamber into the expansion chamber (20*a*, 20*b*); and
   - a fourth valve (40) for controlling the flow of working fluid out of the expansion chamber (40).

15. A heat engine according to clause 14, further comprising:
   - a sensor (62) adapted to output a signal corresponding to a position and/or velocity of the first and second positive displacement elements (11, 21); and
   - a controller (63) for continuously controlling the third and/or fourth valves (39, 40) and/or the rate of supply of the second reactant to the reactor (40) in accordance with the signal output by the sensor (62).

16. A heat engine according to clause 14 or clause 15, wherein the controller (63) is configured to control the first, second, third and fourth valves (36, 37, 38, 39, 40).

17. A heat engine according to any preceding clause, wherein the second displacement member (21) divides the expansion chamber (20*a*, 20*b*) into two expansion subchambers (20*a*, 20*b*).

18. A heat engine according to clause 17 in combination with any of clauses 10 to 12, wherein the third valve (39) is adapted to control the flow of working fluid alternately to each expansion subchamber (20*a*, 20*b*).

19. A heat engine according to any preceding clause, wherein the first displacement member (11) divides the compression chamber (10*a*, 10*b*) into two compression subchambers (10*a*, 10*b*).

20. A heat engine according to clause 19 in combination with any of clauses 10 to 12, wherein the first valve (36) is adapted to control the flow of working fluid alternately to each compression subchamber (10*a*, 10*b*).

21. A heat engine according to any preceding clause, further comprising an energy conversion device (60, 61) comprising at least one reciprocable element (61) coupled for reciprocation with the first and second displacement members (11, 21).

22. A heat engine according to clause 21, wherein the energy conversion device (60, 61) is positioned between the compression chamber (10*a*, 10*b*) and the expansion chamber (20*a*, 20*b*).

23. A heat engine (101) comprising:

a reactor;

a condenser (50) for condensing a gas in a working fluid of the heat engine (101);

a first conduit (33) fluidly coupling an outlet (71) of the reactor to an inlet (56) of the condenser (50); and a second conduit (34) fluidly coupling an outlet (55) of the condenser (50) to an inlet (72) of the reactor.

24 A heat engine (101) according to clause 23, wherein the reactor is the combustion chamber of an internal combustion engine (70).

25. A heat engine according to the preceding clause, further comprising a first supply line (35) configured for supplying a first reactant into the first and/or second conduit (33, 34).

26. A heat engine according to clause 24 or 25, comprising a second supply line (41) for supplying a second reactant into the working fluid.

27. A heat engine according to the preceding clause, wherein the second supply line (41) is configured to supply the second reactant:

into the second conduit (34), or into the reactor.

28. A heat engine according to any of clauses 23 to 27, wherein the condenser (50) comprises a drainage line (54) for draining the condensate from the condenser (50).

29. A heat engine according to any of clauses 23 to 28, wherein the condenser (50) comprises a cooling circuit (53, 57) for cooling the working fluid.

30. A heat engine according to any of clauses 23 to 29, further comprising a working fluid, wherein the working fluid comprises a diluent, the concentration of the diluent in the working fluid being at least 5% by volume, or at least 10% by volume, or at least 20% by volume, or at least 30% by volume, or at least 40% by volume, or at least 50% by volume, or at least 60% by volume, or at least 70% by volume, or at least 80% by volume.

31. A heat engine according to the preceding clause, wherein the diluent has a ratio of specific heats which is at least 1.4, or at least 1.45, or at least 1.5, or at least 1.6.

32. A heat engine according to clause 29 or 31, wherein the diluent is Ar, He, Ne, Kr, or Xe.

33. A heat engine according to any of clauses 23 to 32, wherein the concentration of $N_2$ in the working fluid is less than 70% by volume, less than 60% by volume, less than 50% by volume, less than 40% by volume, less than 30% by volume, less than 20% by volume, less than 10% by volume, or less than 5% by volume.

34. A method of operating a heat engine according to any preceding clause, the method comprising:

providing a working fluid to the heat engine, wherein the working fluid comprises a diluent, and the concentration of the diluent in the working fluid is at least 5% by volume.

35. A method according to clause 34, wherein the concentration of diluent in the working fluid is at least 10% by volume, or at least 20% by volume, or at least 30% by volume, or at least 40% by volume, or at least 50% by volume, or at least 60% by volume, or at least 70% by volume, or at least 80% by volume.

36. A method according to clause 34 or 35, wherein the diluent has a ratio of specific heats which is at least 1.4, or at least 1.45, or at least 1.5, or at least 1.6.

37. A method according to any of clauses 34 to 36, wherein the diluent is Ar, He, Ne, Kr, or Xe.

38. A method according to any of clauses 34 to 37, wherein the concentration of $N_2$ in the working fluid is less than 70% by volume, or less than 60% by volume, or less than 50% by volume, or less than 40% by volume, or less than 30% by volume, or less than 20% by volume, or less than 10% by volume, or less than 5% by volume.

39. A method according to any of clauses 34 to 38, comprising supplying a first and a second reactant into the working fluid.

40. A method according to the preceding clause, wherein the first reactant is $O_2$.

41. A method according to clause 39 or 40, wherein the second reactant is $H_2$.

42. A method according to any of clauses 34 to 41, comprising condensing a combustion product in the condenser (50), the combustion product comprising $H_2O$.

What is claimed is:

1. A heat engine comprising:

a reactor comprising a combustion chamber of an internal combustion engine, in which a first reactant and a second reactant in a working fluid can react with each other;

a condenser for:

receiving the working fluid comprising a gas and a pre-condenser concentration of a diluent; and condensing the gas in the working fluid into a condensate, the gas being a combustion product from a reaction of the first and second reactants;

wherein the remaining working fluid flowing from the condenser has a post-condenser concentration of the diluent that is greater than the pre-condenser concentration; and wherein the condenser comprises a cooling circuit for cooling the working fluid;

a first conduit fluidly coupling an outlet of the reactor to an inlet of the condenser; and a second conduit fluidly coupling an outlet of the condenser to an inlet of the reactor;

wherein the diluent operates in a closed loop in the heat engine;

wherein the pre-condenser concentration of the diluent in the working fluid in the first conduit is greater than 50% by volume;

wherein the pre-condenser concentration of the diluent in the working fluid is at least 5% by volume;

wherein the diluent has a ratio of specific heats which is at least 1.4; and wherein the diluent is selected from the group consisting of Ar, He, Ne, Kr, and Xe.

2. The heat engine according to claim 1 further comprising a first supply line configured for supplying the first reactant into the first and/or second conduit.

3. The heat engine according to claim 1 further comprising a second supply line configured for supplying the second reactant into the working fluid.

4. The heat engine according to claim 3, wherein the second supply line is configured to supply the second reactant into:

the second conduit; or the reactor.

5. The heat engine according to claim 1, wherein the working fluid comprises $N_2$ in a concentration of less than 5% by volume.

6. A heat engine comprising:

a reactor;

a condenser for:

receiving a working fluid comprising a gas and a pre-condenser concentration of a diluent; and condensing the gas in the working fluid of the heat engine into a condensate;

wherein the remaining working fluid flowing from the condenser has a post-condenser concentration of the diluent that is greater than the pre-condenser concentration; and wherein the condenser comprises a cooling circuit for cooling the working fluid;

a first conduit fluidly coupling an outlet of the reactor to an inlet of the condenser;

a second conduit fluidly coupling an outlet of the condenser to an inlet of the reactor;

a first supply line configured for supplying a first reactant into one or both of the first and second conduits; and a second supply line for supplying a second reactant into the working fluid;

wherein the reactor is a combustion chamber of an internal combustion engine;

wherein the gas is a combustion product from a reaction of the first and second reactants;

wherein the diluent operates in a closed loop in the heat engine;

wherein the pre-condenser concentration of the diluent in the working fluid in the first conduit is greater than 50% by volume;

wherein the pre-condenser concentration of the diluent in the working fluid is at least 5% by volume;

wherein the diluent has a ratio of specific heats which is at least 1.4;

wherein the diluent is selected from the group consisting of Ar, He, Ne, Kr, and Xe; and wherein the second supply line is configured to supply the second reactant into one of:

the second conduit; and the reactor.

7. The heat engine according to claim 6, wherein the condenser comprises a drainage line for draining the condensate from the condenser.

8. The heat engine according to claim 6, wherein the diluent has a ratio of specific heats which is at least 1.6.

9. A method of operating a heat engine comprising:

providing the working fluid to the heat engine of claim 6.

10. The method according to claim 9 further comprising:

supplying the first reactant; and supplying the second reactant.

11. The method according to claim 10, wherein the working fluid comprises the first and second reactants; and wherein the first reactant is $O_2$.

12. The method according to claim 11, wherein the second reactant is $H_2$.

13. The method according to claim 9 further comprising condensing the combustion product in the condenser, the combustion product comprising $H_2O$.

14. The heat engine according to claim 6, wherein the working fluid comprises $N_2$ in a concentration of less than 5% by volume.

15. A heat engine comprising:

a reactor;

a condenser for condensing a gas in a working fluid of the heat engine into a condensate;

a first conduit fluidly coupling an outlet of the reactor to an inlet of the condenser;

a second conduit fluidly coupling an outlet of the condenser to an inlet of the reactor;

a first supply line configured for supplying a first reactant into one or both of the first and second conduits; and a second supply line for supplying a second reactant into the working fluid;

wherein:

the reactor is a combustion chamber of an internal combustion engine;

the second supply line is configured to supply the second reactant into one of:

the second conduit; and the reactor;

the heat engine further comprises the working fluid;

the working fluid comprises a diluent;

the diluent operates in a closed loop in the heat engine;

the diluent has a pre-condenser concentration in the working fluid of at least 5% by volume;

the diluent has a ratio of specific heats which is at least 1.4;

the diluent is selected from a group consisting of Ar, He, Ne, Kr, and Xe;

the gas is a combustion product from a reaction of the first and second reactants;

the condenser receives the working fluid comprising the gas and having a pre-condenser concentration of the diluent;

the remaining working fluid flowing from the condenser has a post-condenser concentration of the diluent that is greater than the pre-condenser concentration;

the pre-condenser concentration of the diluent in the working fluid in the first conduit is greater than 50% by volume; and the condenser comprises a cooling circuit for cooling the working fluid.

16. The heat engine according to claim 15, wherein the working fluid comprises $N_2$ in a concentration of less than 5% by volume.

* * * * *